US005164249A

United States Patent [19]

Tyler et al.

[11] Patent Number: 5,164,249

[45] Date of Patent: Nov. 17, 1992

[54] CONTROLLED POROSITY PAPERMAKING FABRIC

[75] Inventors: John D. Tyler, Easley; Volker Ostermayer, Greenville, both of S.C.

[73] Assignee: Wangner Systems Corporation, Greenville, S.C.

[21] Appl. No.: 796,611

[22] Filed: Nov. 22, 1991

[51] Int. Cl.[5] ..... D03D 3/00

[52] U.S. Cl. ..... 428/225; 28/158; 139/383 A; 428/229; 428/255; 428/257; 428/258

[58] Field of Search ..... 28/102, 158; 428/255, 428/257, 258, 225, 229; 139/383 A; 162/348, DIG. 1

[56] References Cited

U.S. PATENT DOCUMENTS

| | | | |
|---|---|---|---|
| 4,640,741 | 2/1987 | Tsuneo | 428/225 |
| 4,909,284 | 3/1990 | Hositzke | 428/224 |
| 5,056,565 | 10/1991 | Kufferath | 139/383 A |

*Primary Examiner*—James J. Bell

*Attorney, Agent, or Firm*—Cort Flint

[57] ABSTRACT

A multi-layered paper machine fabric having a preselected permeability value, comprising a single system of warp yarns and a multiple layers of weft yarns. The weft yarns include support surface weft yarns intermediate layer weft yarns and lower surface weft yarns all interwoven with the single system of warp yarns. The surface layer weft yarns are of a first thickness, the lower layer weft yarns are of a second thickness, and the intermediate layer of weft yarns are of a third thickness which differs from the first and second thicknesses. Certain ones of the support surface weft yarns are interwoven with the warp yarns to be vertically aligned with the lower surface weft yarns to form drainage channels therebetween. Certain of the intermediate weft yarns are interwoven with the warp yarns to be located intermediate of the surface weft yarns and the lower weft yarns and centrally of the drainage channels. The thickness of the intermediate weft yarn is selected between predetermined ranges to determine the preselected permeability.

24 Claims, 6 Drawing Sheets

CONTROLLED POROSITY PAPERMAKING FABRIC

BACKGROUND OF THE INVENTION

This invention relates to a paper machine fabric capable of being formed with a wide range of porosities and yet retains a constant yarn count and caliper. More particularly, the porosity and density of the paper support surface remains constant which allows for a controlled high fiber retention while the total fabric porosity is variable between a preselected range as desired.

In the past attempts have been made to form paper machine fabrics having controllable porosity without recognizing the desirability for a constant yarn count and fabric caliper. For example, U.S. Pat. No. 4,379,735 is concerned with lateral or weft wise stiffness of a paper machine fabric. The patent discloses forming vertical drainage channels and varying the porosity by varying the fabric mesh or count along with varying the warp and weft yarn thickness. U.S. Pat. No. 4,867,206 is concerned with forming a two ply fabric having vertical drainage channels in each ply which interconnect to form vertical drainage channels which get progressively larger toward the lower surface. U.S. Pat. No. 4,640,741 provides a multi-layer paper machine fabric having three layers of vertically stacked weft yarns and two layers of warp yarns forming vertical drainage channels. The lower layer has a "coarser weft density" than that of the intermediate layer and the weft density of the intermediate layer is smaller than the uppermost weft layer. The porosity is controlled by varying the warp density and yarn count. U.S. Pat. No. 4,941,514 is concerned with providing a paper machine fabric in which vertical drainage channels are formed by vertically stacking three layers of weft yarns. The patent discloses varying the fabric permeability by varying the thickness of the intermediate layer of weft yarns. Finally, U.S. Pat. No. 4,909,284 is directed to a paper machine fabric in which a support surface is formed with two sets of weft yarns, a lower surface is formed with one set of weft yarns. The lower weft yarns are vertically aligned with one set of the upper weft yarns.

None of the above patents recognize the problem of maintaining a support surface of constant count and density, varying the density of the intermediate layer while maintaining a constant count, and maintaining the lower layer constant while at the same time maintaining a constant fabric caliper.

It is a further object of this invention to provide a constant paper support surface so that markings formed are minimal and uniform and the paper fiber retention remains constant.

It is a further object of this invention to provide a constant fabric caliper so that the pressure exerted on the paper fibers is uniform.

It is a further object of this invention to vary the porosity of the paper forming fabric between selected limits while maintaining a constant yarn count.

It is another object of the invention to provide a paper machine fabric which has been heat set under tension for stability, has a constant caliper, and which is of controlled permeability while the paper fiber support surface does not vary.

SUMMARY OF THE INVENTION

A multi-layered paper machine fabric having a preselected permeability value, comprising a single system of warp yarns and a multiple layers of weft yarns. The weft yarns include support surface weft yarns intermediate layer weft yarns and lower surface weft yarns all interwoven with the single system of warp yarns. The surface layer weft yarns are of a first thickness, the lower layer weft yarns are of a second thickness, and the intermediate layer of weft yarns are of a third thickness which differs from the first and second thicknesses. Certain ones of the support surface weft yarns are interwoven with the warp yarns to be vertically aligned with the lower surface weft yarns to form drainage channels therebetween. Certain of the intermediate weft yarns are interwoven with the warp yarns to be located intermediate of the surface weft yarns and the lower weft yarns and centrally of the drainage channels. The thickness of the intermediate weft yarn is selected between predetermined ranges to determine the preselected permeability. Certain others of the support surface weft yarns are interwoven with the system of warp yarns so as to be disposed vertically above the referred to certain intermediate weft yarns. These first weft yarns have a fourth thickness which may be less than the first thickness or the same thickness as the first thickness. Certain of the intermediate weft yarns are interwoven with the system of warp yarns so as to be disposed intermediate of the first certain ones of the support surface weft yarns and the lower surface weft yarns and in vertical alignment therewith.

The multi-layer fabric is formed so that the weft count and the fabric caliper remain constant regardless of the thickness selected for the certain of the intermediate weft yarns. The number of warp yarns per weave pattern repeat may be eight and the number of weft yarns per weave pattern repeat may be forty; or the number of warp yarns per weave pattern repeat may be seven and the number of weft yarns per weave pattern repeat may be thirty-five. The weft count of the support layer may be equal that of the intermediate layer or it may be twice that of the intermediate layer. The weft yarns of the upper layer have a thickness of between 0.10 mm and 0.50 mm, the weft of the intermediate layer has a thickness of between 0.12 and 0.50 mm and the weft of the lower layer has a thickness of between 0.14 mm and 0.50 mm. The support layer weft yarns and the intermediate layer weft yarns are polyester monofilaments and the lower layer weft yarns may be also polyester monofilaments or they may be polyamide monofilaments. The porosity range is between 200 CFM and 800 CFM.

The fabric is heat set under tension to provide stability and a smooth and even support surface having high paper product fiber retention.

The construction designed to carry out the invention will hereinafter be described, together with other features thereof.

The invention will be more readily understood from a reading of the following specification and by reference to the accompanying drawings forming a part thereof, wherein an example of the invention is shown and wherein:

DESCRIPTION OF THE PREFERRED EMBODIMENTS

In paper making it is of paramount importance that the texture and feel of the paper product produced be constant. Conditions which act to vary the feel and texture of the paper product during production are variations in the smoothness of the support surface, variation in the yarn count of the support surface and variations in the fiber retention of the paper product by the support surface. Also, unevenness of pressure applied by the nip rolls will result in the paper product having inconsistent characteristics of feel and appearance.

The instant invention overcomes these inconsistencies. The fabric of the invention consists of a multi-layered fabric which has been heat set under tension. Normally, heat setting takes place at temperatures between 150° to 400° F. for from 15 to 60 minutes. Heat treating produces a stable fabric with an upper surface having a smooth paper product support surface with evenly disposed knuckles and uniform spaces between the yarns to allow even drainage. The upper surface, which is formed with a separate layer of weft yarns, is supported by an intermediate layer of weft yarns and a lower layer of weft yarns. The three layers of weft yarns are interwoven with a single system of warp yarns intertwined with the weft yarns in such a manner as to firmly locate each weft yarn of each layer in a substantially permanent position.

Depending upon the paper product being formed it is necessary at times to adjust porosity and drainage channels of the paper machine fabric. In the past, as earlier referred to, this entailed varying the yarn count by placing certain yarns closer together. Alternatively, it has been proposed to vary the size of an intermediate of three layers of weft yarns. The first approach obviously changes the characteristics of the support surface of the fabric. The second approach while not necessarily changing the support surface, changes the caliper or the vertical dimension of the fabric. This effects the degree of pressure applied to the paper product and the forming fabric by the paper machine rolls. Both approaches result in variations of texture and appearance in the paper product. The instant invention acts to overcome these drawbacks as set forth in detail hereinafter.

Figure 1:
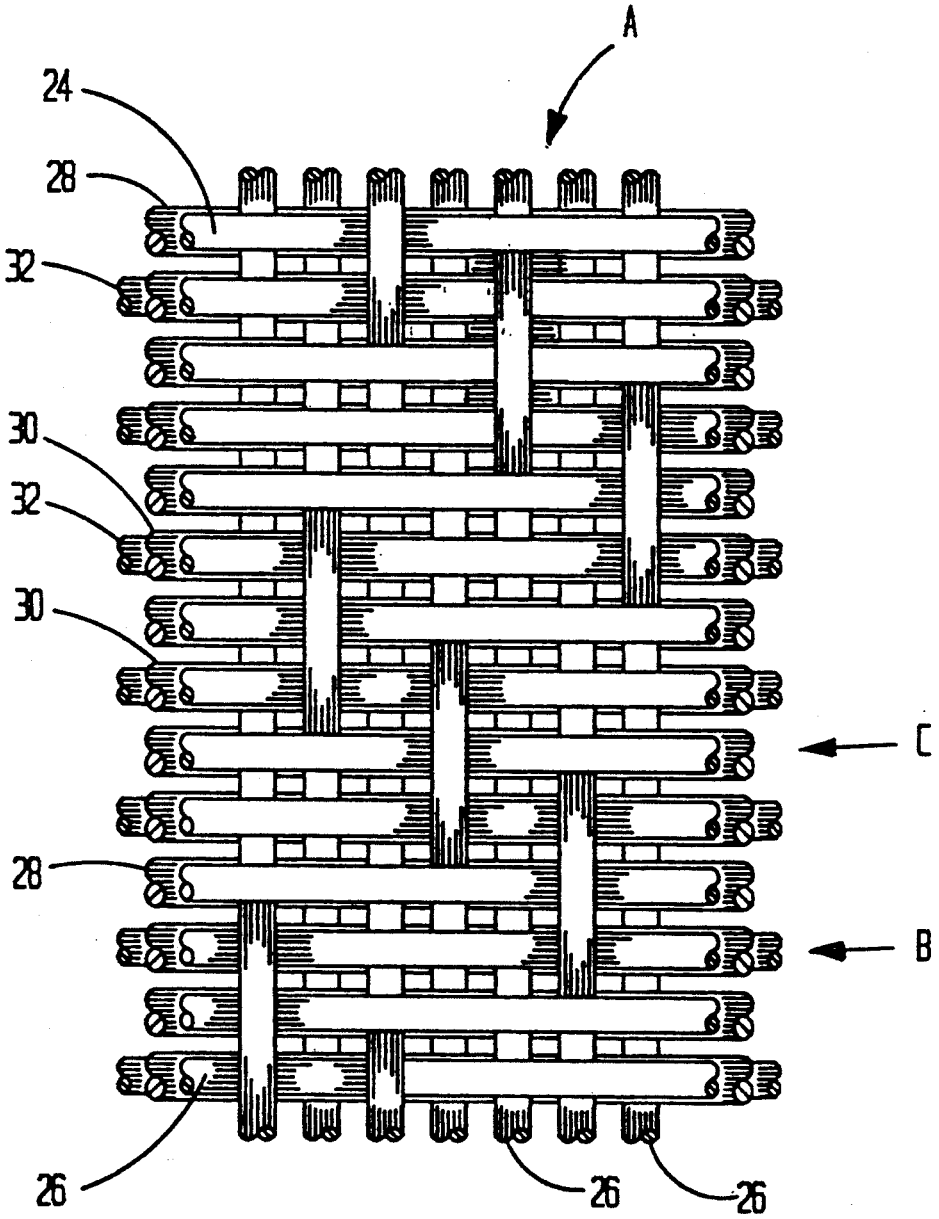
FIG. 1 is a sectional top view of the paper forming fabric shown in the weave diagram of FIG. 4.
Figure 4:
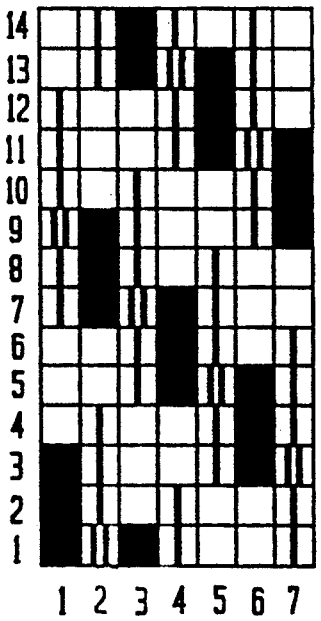
FIG. 4 is the weave diagram of a preferred embodiment of the base fabric of the invention.

Turning now to the drawings, FIG. 1 is a top view of paper machine fabric A which is produced by the weave diagram shown in FIG. 4. Paper product support surface 20 is formed by interweaving weft yarns 22, 24 forming an upper layer of weft yarns with the single system of warp yarns 26. Intermediate layer weft yarns 28, 30 and lower layer weft yarns 32 are also interwoven with the single system of warp yarns 26 forming spaced vertical rows B, C of weft yarns.

Figure 2:
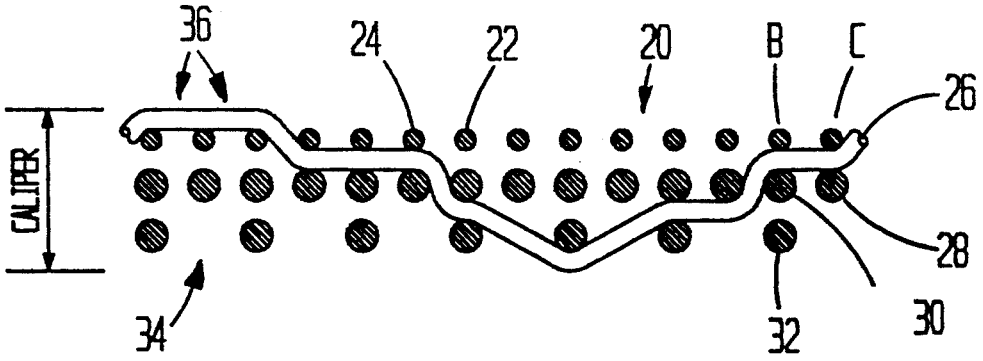
FIGS. 2 and 3 are sectional side views showing warp yarns 1 and 2 of the weaving pattern repeat with the weft yarns of the weave pattern diagramed in FIG. 4.
Figure 3:
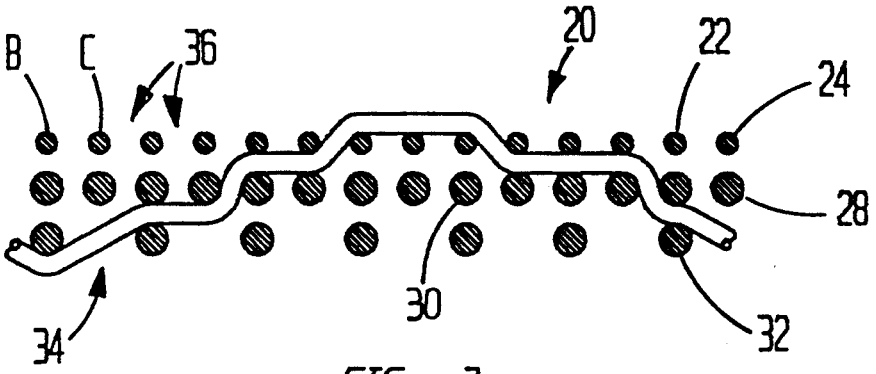

FIGS. 2 through 4, show a complete repeat of a weave pattern of the paper machine fabric of the invention which includes thirty-five insertions of weft yarn interwoven with seven warp yarns. FIG. 2 shows the path of the first warp yarn of the pattern repeat weaving with the three layers of weft yarns 22, 24, 28, 30 and 32. FIG. 4 also shows diagrammatically the path of the first warp yarn through the weft yarns. As can be seen in the figures, warp 26 passes over three vertical rows B, C of weft yarns, between the upper and intermediate weft yarns of the next two vertical rows, beneath two weft yarns of the upper and intermediate layers of the next three vertical rows and finally beneath all weft yarns of a single vertical row. The warp yarn then passes beneath two weft yarns of the upper and intermediate rows of the next three vertical rows and finally between the upper and intermediate weft yarns of the final four rows complete the weave pattern.

FIG. 3 shows in similar fashion warp yarn 26 weaving as the second warp yarn of the pattern also indicated in the pattern diagram of FIG. 4. The warp, weft relationships of the third through the seventh warp yarns can easily be determined from the pattern diagram of FIG. 4. FIG. 4 further shows that the fabric formed presents a paper product support surface 20 composed primarily of long weft yarn floats. Such type of weft yarn dominated support surface presents a minimum of warp knuckle deformations. It is also apparent from FIG. 4, that the lower surface is also weft float dominated, there being only eight warp knuckles present per pattern repeat. This arrangement allows for the use of smaller, more flexible polyester yarns as the warp yarns. The upper layer weft yarns, the lower layer weft yarns, and the intermediate layer weft yarns are also polyester yarns with the intermediate layer weft yarns being normally of a larger diameter. Polyester yarns are extremely stable and resistant to heat and chemicals. Polyamide yarns may alternatively be used as the lower layer weft yarns. Polyamide yarns while not as stable as polyester yarns, possess greater wear resistance properties. While monofilament yarns of polyester are preferred, it is noted that monofilaments of PCP or polypropylene are acceptable.

FIGS. 5 through 16 show alternative embodiments of seven or eight warp yarn weave patterns forming the paper forming fabric of the invention. It is not seen that it is necessary to describe in detail each of the warp yarn paths through the weft yarns for each fabric as the weave patterns shown in FIGS. 7, 10, 13, and 16 clearly show these structures in a manner which can be easily understood by one skilled in the art.

Figure 5:
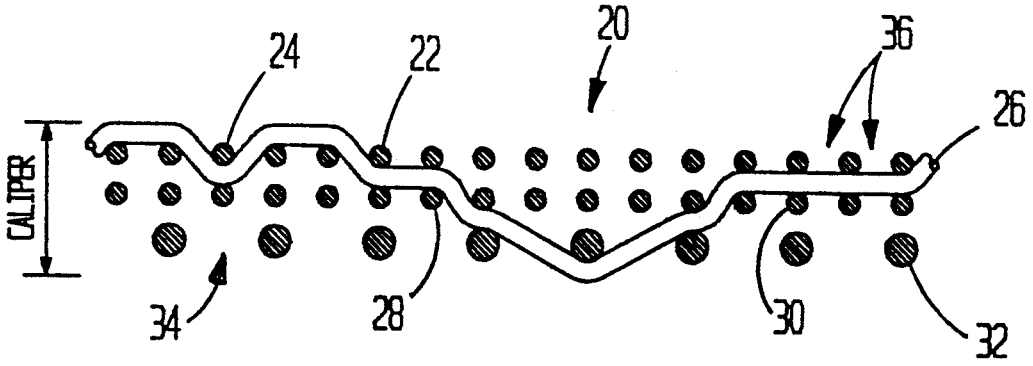
FIGS. 5 and 6 are sectional side views showing warp yarns 1 and 2 weaving with the weft yarns of the weave pattern diagramed in FIG. 7.
Figure 6:
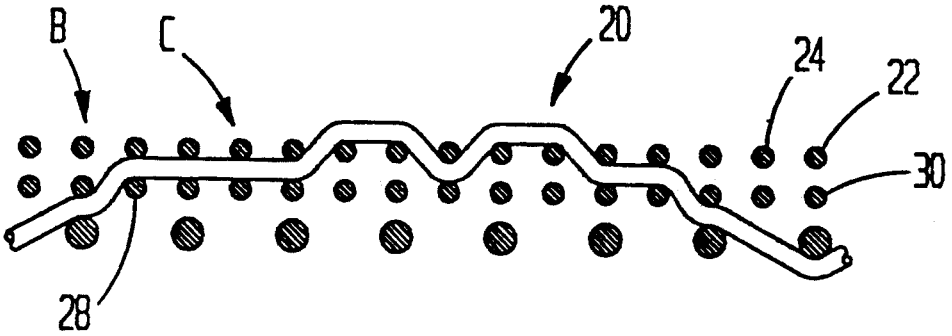
Figure 7:
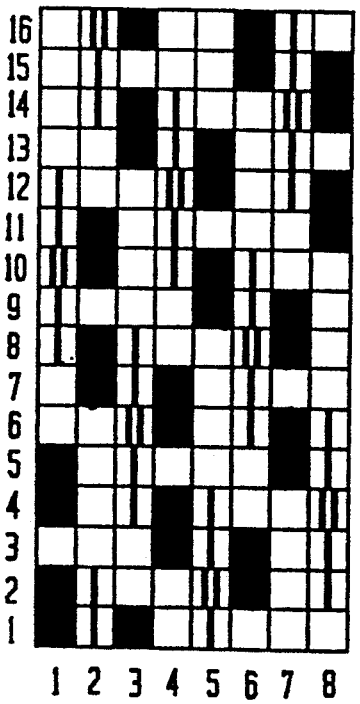
FIG. 7 is a diagram of the weave pattern of an alternative embodiment of the base fabric.
Figure 8:
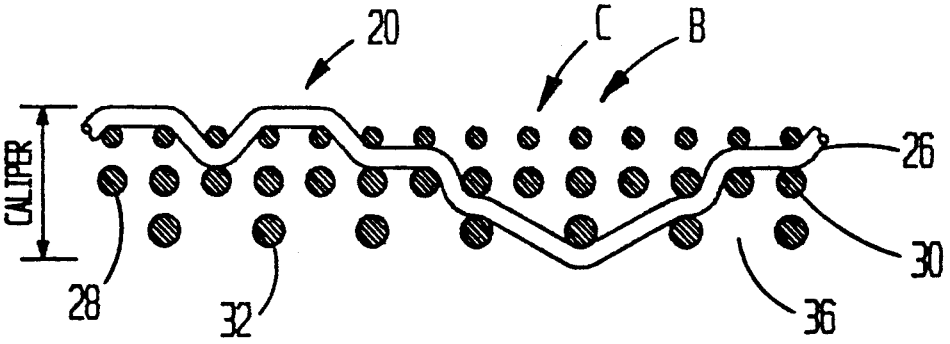
FIGS. 8 and 9 are sectional side views showing warp yarns 1 and 2 weaving with the weft yarns of the weave pattern diagramed in FIG. 10.
Figure 9:
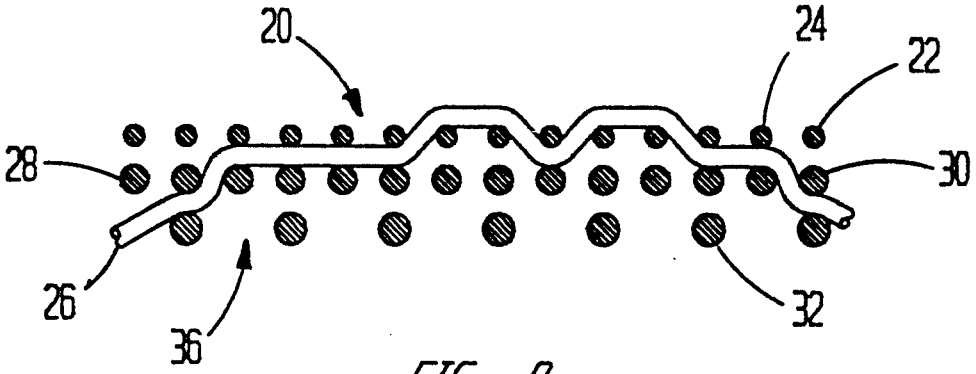
Figure 10:
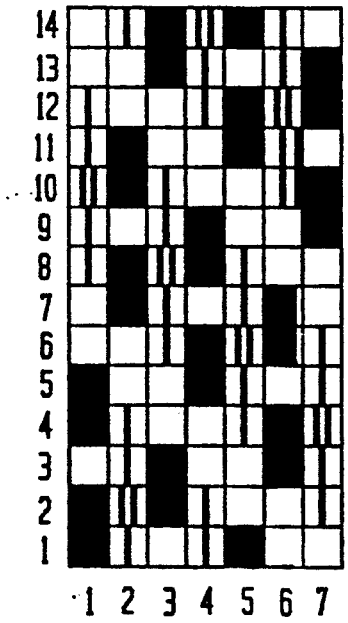
FIG. 10 is a diagram of an alternative embodiment of the base fabric.
Figure 11:
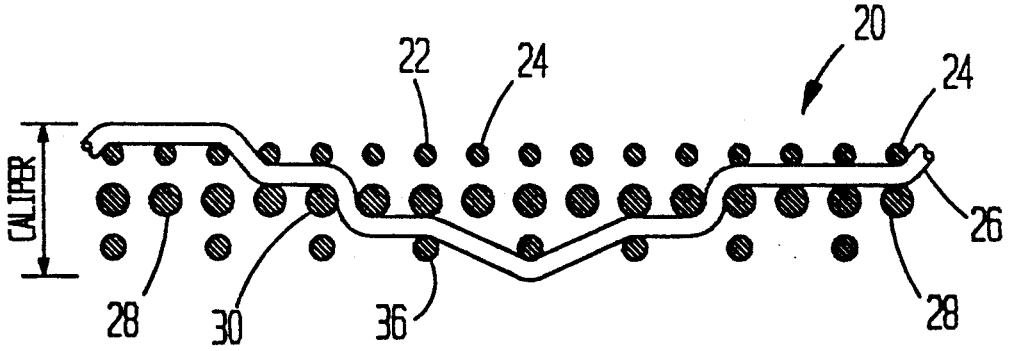
FIGS. 11 and 12 are sectional side views showing warp yarns 1 and 2 weaving with the weft yarns of the weave pattern diagramed in FIG. 13.
Figure 12:
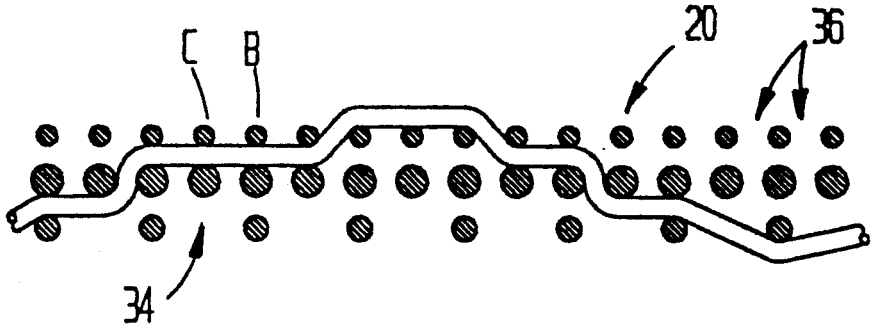
Figure 13:
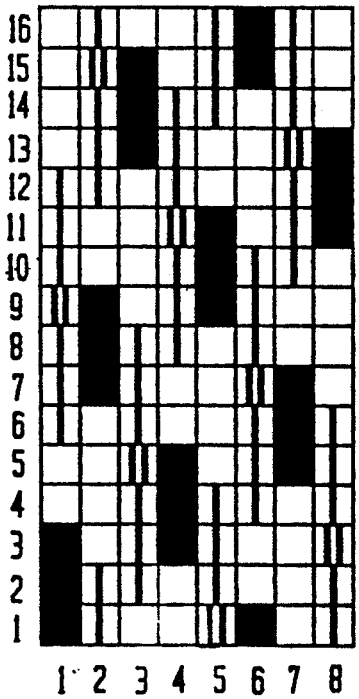
FIG. 13 is a diagram of the weave pattern of an alternative embodiment of the base fabric.

Referring now to FIGS. 2, 3, 5, 6, 8, 9, 11, 12, 14 and 15, it can be seen that each weave pattern produces a fabric having an upper weft layer 22, 24 an intermediate weft layer 28, 30 and a lower weft layer 32 with a single system of warp yarns 26 woven with the weft layers to form spaced vertical rows of weft yarns as indicated at B, C. Adjacent vertical rows of weft yarns form drainage channels 32 through the fabric which allows the liquid removed from the paper product on the support surface 20 to pass through the fabric and be removed therefrom at the lower surface at 34. The vertical weft rows consist of first rows B which are formed of weft yarns 22 from the support surface, intermediate layer weft yarns 28, 30 and lower layer weft yarns 32 and second rows C which are formed of weft yarns 24, 28 of the support surface and the intermediate layers. Alternative variations of weft yarn sizes are shown in the drawings. FIGS. 2 and 3 show weft yarns 28, 30, 32 as being substantially the same size. FIGS. 5 and 6 show weft yarns 28, 30 as smaller than yarns 32. FIGS. 11 and 12 show weft yarns 28, 30 as larger than yarns 32. They also show yarns 24 as smaller than yarns 22. Other weft yarn combinations are within the scope of the invention.

In order to control the rate of liquid flow through the fabric, the size of the drainage channels 32 is controlled by varying the size of intermediate layer weft yarn 28 of vertical row C. It is important that only this group of weft yarns be altered because there is an open area 34 there beneath. This open area 34 allows changes in the thickness of weft yarns 28 which changes the size of vertical channels 36 within the fabric interior while no change in the thickness of the fabric or in the fabric caliper occurs. As an alternative, it is not necessary that weft yarns 24 be present in the support surface. In this instance only, weft yarns 28 would form the second vertical row weft yarns.

Figure 14:
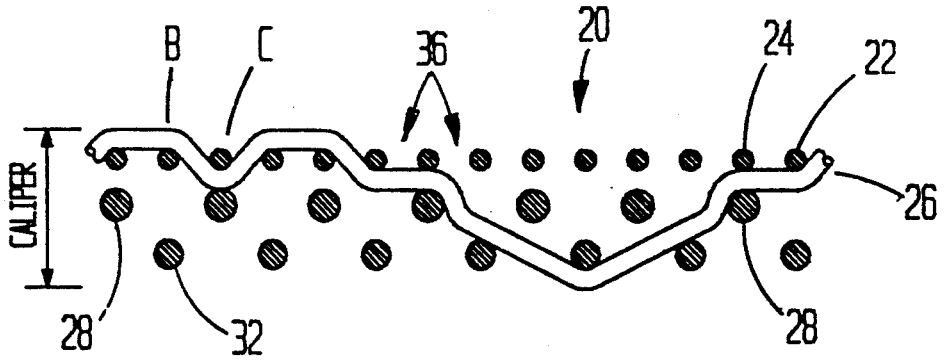
FIGS. 14 and 15 are sectional side views showing warp yarns 1 and 2 weaving with the weft yarns of the weave pattern diagramed in FIG. 16.
Figure 15:
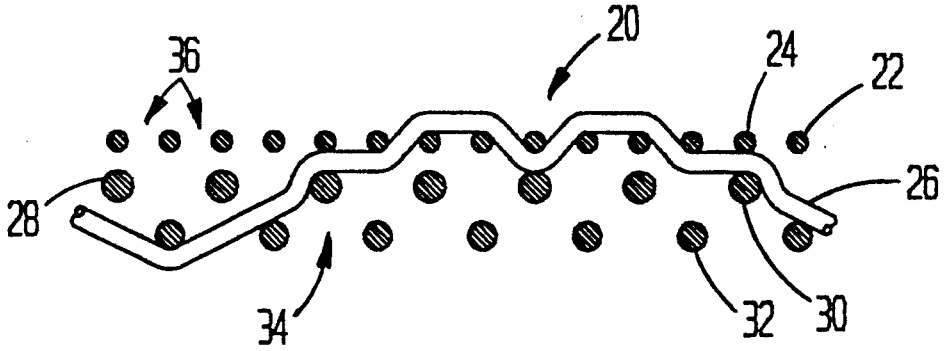
Figure 16:
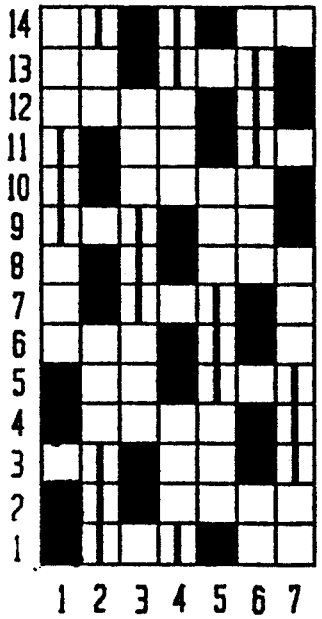
FIG. 16 is a diagram of the weave pattern of an alternative embodiment of the base fabric.

FIGS. 14 through 16 show a slightly modified embodiment. Here, the first vertical row B of weft yarns is formed by only weft yarns 22, 32 from the support layer and the lower layer of weft yarns. The second vertical row C of vertically arranged weft yarns is formed by the intermediate layer weft yarns 28 and alternate ones of the upper row of weft yarns 24. As shown in FIG. 16, this pattern consists of only twenty-eight weft yarns. Optionally, these alternate weft yarns 24 may also be omitted.

The fabrics of the invention are formed with a count of between 53 and 155 warp yarns per inch and 61 and 207 weft yarns per inch. The fabrics have an air permeability, expressed in cubic feet per minute per square foot, of between 200 CFM and 800 CFM. The fabric caliper ranges between 0.60 mm and 2.50 mm depending upon the size of the warp yarns and the stacked weft yarns. The warp yarns have a diameter of between 0.12 mm and 0.50 mm. The upper layer of weft yarns have a diameter of between 0.10 mm and 0.50 mm, the intermediate layer weft yarns a diameter of between 0.12 mm and 0.50 mm and the support layer of weft yarns a thickness of between 0.14 mm and 0.50 mm. The support layer presents a smooth substantially knuckle free surface for the paper product which provides a retention rate of between sixty percent and eighty percent of the product fibers during passage thereof through the paper forming machine.

An example of the invention would be a paper machine fabric having a porosity of 420 CFM, a caliper of 1.11 mm, a count of 152 warp yarns per inch and 175 weft yarns per inch. The fabric would have support surface weft yarns of polyester monofilaments of 0.18 mm diameter, intermediate layer polyester weft yarns 0.25 mm diameter and support surface weft yarns of 0.20 mm diameter. The fabric has been heat set at 350° F. Circumstances may require a change of porosity. In that event, weft yarns 28 of the intermediate vertical row C of weft yarns may necessitate a diameter of 0.26 mm. Substituting this larger weft yarn into the fabric would bring the porosity to the desired CFM while maintaining constant the yarn count and the caliper.

While a preferred embodiment of the invention has been described using specific terms, such description is for illustrative purposes only, and it is to be understood that changes and variations may be made without departing from the spirit or scope of the following claims.

What is claimed is:

1. A multi-layered paper machine fabric having a constant caliper and preselected permeability value, said fabric comprising:

a single system of synthetic warp yarns;

multiple layers of synthetic weft yarns including support surface weft yarns, intermediate layer weft yarns and lower surface weft yarns interwoven with said system of warp yarns;

said surface layer weft yarns having a first thickness;

said lower layer weft yarns having a second thickness;

said intermediate layer weft yarns having a third thickness which differs from said first and second thicknesses;

first ones of said support surface weft yarns are interwoven with said warp yarns to be vertically aligned with said lower surface weft yarns to form drainage channels therebetween;

at least certain of said intermediate weft yarns are interwoven with said warp yarns to be intermediate said surface weft yarns and said lower weft yarns and to be centrally of said drainage channel, the thickness of said intermediate weft yarn being selected to determine said preselected permeability.

2. The multi-layer fabric of claim 1 wherein said third thickness is greater than said first and second thicknesses.

3. The multi-layer fabric of claim 1 wherein said third thickness is less than said first and second thicknesses.

4. The multi-layer fabric of claim 1 wherein said fabric is heat set under tension to provide greater stability and a smooth even support surface.

5. The multi-layer fabric of claim 1 wherein second ones of said support surface weft yarns are interwoven with said system of warp yarns to be disposed vertically above said at least certain intermediate weft yarns.

6. The multi-layer fabric of claim 3 wherein said second ones of said first weft yarns have a fourth thickness which is less than said first thickness.

7. The multi-layer fabric of claim 3 wherein said second ones of said first weft yarns are of said first thickness.

8. The multi-layer fabric of claim 1 wherein all others of said intermediate weft yarns are interwoven with said system of warp yarns to be disposed intermediate of said first ones of said support surface weft yarns and said lower surface weft yarns and in vertical alignment therewith.

9. The multi-layer fabric of claim 1 wherein the weft count and fabric caliper remain constant regardless of the thickness selected for said certain ones of said intermediate warp yarns.

10. The multi-layer fabric of claim 1 wherein the number of warp yarns per weave pattern repeat is eight and the number of weft yarns per weave pattern repeat is sixteen.

11. The multi-layer fabric of claim 1 wherein the number of warp yarns per weave pattern repeat is seven and the number of weft yarns per weave pattern repeat is fourteen.

12. The multi-layer fabric of claim 1 wherein the weft count of the support layer is equal that of the intermediate layer.

13. The multi-layer fabric of claim 1 wherein the weft count of the support layer is twice that of the intermediate layer.

14. The multi-layer fabric of claim 1 wherein the weft of the upper layer has a thickness of between 0.10 mm and 0.50 mm.

15. The multi-layer fabric of claim 1 wherein the weft of the intermediate layer has a thickness of between 0.12 mm and 0.50 mm.

16. The multi-layer fabric of claim 1 wherein the weft of the lower layer has a thickness of between 0.14 mm and 0.50 mm.

17. The multi-layer fabric of claim 1 wherein the support layer weft yarns and the intermediate layer weft yarns are polyester monofilaments and the support layer weft yarns are polyamide monofilaments.

18. The multi-layer fabric of claim 1 wherein the selected porosity is between 200 CFM and 800 CFM.

19. The method of forming a multi-layered paper machine fabric having a constant caliper and preselected permeability value, said fabric comprising:

providing a single system of warp yarns;

providing multiple layers of weft yarns including support surface weft yarns, intermediate layer weft yarns and lower surface weft yarns interwoven with said system of warp yarns;

providing said surface layer weft yarns to be of a first thickness;

providing said lower layer weft yarns to be of a second thickness;

providing said intermediate layer weft yarns to be of a third thickness which differs from said first and second thicknesses;

interweaving first ones of said support surface weft yarns with said warp yarns to be vertically aligned with said lower surface weft yarns to form drainage channels therebetween;

interweaving at least certain of said intermediate weft yarns with said warp yarns to be intermediate said surface weft yarns and said lower weft yarns centrally of said drainage channel and; selecting the thickness of said intermediate layer of weft yarns to determine said preselected permeability while maintaining the fabric count and caliper constant.

20. The method as set forth in claim 19 comprising the step of placing the fabric under tension and heat setting said fabric while under tension to provide stability and a smooth even support surface.

21. The method as set forth in claim 19 comprising the step of interweaving ones of said support surface weft yarns with said system of warp yarns to be disposed vertically above said at least certain intermediate weft yarns.

22. The method of claim 19 comprising the step of interweaving others of said intermediate weft yarns with said system of warp yarns to be disposed intermediate of said first ones of said support surface weft yarns and said lower surface weft yarns and in vertical alignment therewith.

23. The method set forth in claim 19 including the step of providing that the count of the support layer is equal that of the intermediate layer.

24. The method set forth in claim 19 including the step of providing that the count of the support layer is twice that of the intermediate layer

* * * * *